US006962559B2

(12) United States Patent
Tillman et al.

(10) Patent No.: US 6,962,559 B2
(45) Date of Patent: Nov. 8, 2005

(54) ROLLER ARRANGEMENT FOR A BOOKLET MAKER

(75) Inventors: Andreas Tillman, Hässelby (SE); Per-Erik Norberg, Rönninge (SE)

(73) Assignee: Plockmatic International AB, Stockholm-Globen (SE)

( * ) Notice: Subject to any disclaimer, the term of this patent is extended or adjusted under 35 U.S.C. 154(b) by 0 days.

(21) Appl. No.: 10/601,179

(22) Filed: Jun. 20, 2003

(65) Prior Publication Data

US 2004/0124574 A1 Jul. 1, 2004

(30) Foreign Application Priority Data

Jul. 4, 2002 (SE) ..... 0202098

(51) Int. Cl.[7] ..... B31F 1/08
(52) U.S. Cl. ..... 493/428; 493/434; 493/442
(58) Field of Search ..... 270/32, 37, 52.14; 493/428, 434, 435, 442

(56) References Cited

U.S. PATENT DOCUMENTS 3,783,751 A * 1/1974 Winnemoller ..... 493/217
3,786,742 A * 1/1974 Hertrich ..... 100/99
5,007,891 A * 4/1991 von Hein ..... 493/444
5,139,247 A * 8/1992 Meschi ..... 270/39.05
5,169,376 A * 12/1992 Ries et al. ..... 493/445
6,042,529 A * 3/2000 Hubler et al. ..... 493/434
6,142,923 A * 11/2000 Bakoledis ..... 493/243
6,193,641 B1 * 2/2001 Barker ..... 493/420
6,568,668 B1 * 5/2003 Wakabayashi et al. ... 270/58.11
6,709,375 B2 * 3/2004 Groenenberg et al. ..... 493/442
6,755,410 B2 * 6/2004 Kaneko ..... 270/32

* cited by examiner

*Primary Examiner*—Eugene Kim
(74) *Attorney, Agent, or Firm*—Ladas & Parry LLP

(57) ABSTRACT

A roller arrangement for booklet makers comprises at least a first (1) and a second (2) pair of rotatably driven rollers, between which booklets (4) are intended to pass successively for folding. The first pair of rollers comprises two rollers (1) that are arranged such that they can move towards and away from each other and having a spring loading towards each other, while the second pair of rollers (2) comprises two rollers with a mutual separation that can be adjusted. Mechanical means (3) are arranged to, following the insertion of a booklet between the rollers of the first pair of rollers, automatically adjust the mutual separation of the rollers of the second pair of rollers depending on the distance between the rollers of the first pair of rollers.

17 Claims, 3 Drawing Sheets

ROLLER ARRANGEMENT FOR A BOOKLET MAKER

FIELD OF THE INVENTION

The present invention concerns a roller arrangement for a booklet maker comprising at least a first and a second pair of rotatable driven rollers, between which it is intended that booklets are successively to pass for folding, whereby the said first pair of rollers comprises two rollers, arranged such that they can be displaced towards and away from each other and having spring loading towards each other, and the said second pair of rollers comprises two rollers at a mutual separation that can be adjusted.

BACKGROUND

Colour printers are becoming evermore common while requirements on the user-friendliness of the printers increases. The paper that is used in colour printers is glossy or slippery when print has been applied, with very low friction between sheets. Furthermore, the paper used is sensitive to mechanical treatment, and blemishes readily arise in the paper. This leads to problems in roller stages in booklet makers that are currently known. The low friction between the sheets often results in these being separated from each other when the stapled stack of sheets enters between the rollers, that is, the outermost sheet is torn from the booklet. It is currently attempted to solve this problem for this type of machine by manually adjusting with a lever a suitable separation of the rollers of the second pair of rollers. This adjustment must be carried out individually for each booklet thickness and booklet size and the result is often that the booklet after the roller stage has an increased projected booklet height, see FIG. 1, where the projected booklet height a for a schematically shown booklet 2 is illustrated.

Booklet makers are also previously known with motorised, computer-controlled servosystems for adjusting the separation of the rollers of the second pair of rollers as specified by input data. This servosystem is very complex and expensive and thus can only be used on large printing machines.

SUMMARY OF THE INVENTION

The aim of the present invention is to achieve a very simple, purely mechanical solution for the automatic adjustment of the distance between the rollers of the second pair of rollers depending on the distance between the rollers of the first pair of rollers, a design which is so economically advantageous through its simplicity that it can be applied even on the simplest and cheapest types of booklet maker.

This aim is achieved with a roller arrangement of the type specified in the introduction having the features specified in claim 1.

When the rollers of the first pair of rollers are separated as a consequence of the booklet or stack of sheets being introduced between the rollers, the rollers of the second pair of rollers are separated a certain appropriate distance that depends on the separation of the rollers of the first pair of rollers. The adjustment of the distance between the rollers of the second pair of rollers takes place automatically, in a purely mechanical manner, and the adjustment is individually carried out for each individual booklet that is introduced between the first pair of rollers. Since the correct distance between the rollers of the second pair of rollers is achieved in this manner, the rollers can be constructed with low friction, and booklets or stacks with glossy or slippery paper can be folded without damage, while maintaining the projected booklet height.

The concept of "booklet" in this context is taken to mean stapled stacks of a freely chosen number of paper sheets. The booklet maker with the invention can thus be used as a folding machine for individual sheets, such as, for example, letters, and it can be used up to booklets consisting of thick stacks of paper.

According to advantageous embodiments of the arrangement according to the invention, the rollers are mounted in bearings such that they can rotate between two end-pieces arranged at a distance from each other, and that the said means comprises a wedge element arranged at each end-piece that is arranged to be displaced into the space between the rollers of the first pair of rollers when these are separated by a distance equivalent to the size of the space, and furthermore the wedge element is arranged to adjust the distance between the rollers of the second pair of rollers depending on the said distance. The wedge elements have a wedge-shaped end section, intended to be inserted between the rollers of the first pair of rollers when these are separated. The wedge elements are arranged such that they are pressed by the spring force that affects the rollers of the second pair of rollers with their end section into the space between the rollers of the first pair of rollers when these are separated. When the current booklet reaches the second pair of rollers the rollers of this pair of rollers are normally pressed somewhat further apart, which is fed back to the first pair of rollers, the rollers of which are further separated as a result. The pressure onto the booklet from the first pair of rollers in this way decreases somewhat such that the booklet passes more easily between the rollers of the first pair of rollers when the booklet has reached the second pair of rollers.

According to other advantageous embodiments of the arrangement according to the invention, the contact surface of the rollers against the paper is of a material with low friction relative to paper, such as steel. The correct adjustment in each individual case of the distance between the rollers allows rollers with low friction to be used for folding glossy and smooth paper with a maintained projected booklet height.

According to a further advantageous embodiment, at least one of the rollers of the second pair of rollers is designed with at least one track around its circumference at the location at which stapling clamps are intended to pass during the folding, and the track is covered by a ring of flexible material. This is significant for the ability to staple thin booklets, for which the thickness of the thread of the staple clamp is greater than the thickness of the booklet. The flexible material then presses sufficiently hard such that the paper is not creased due to the locally reduced pressure in the region of the track, while not so hard that the paper is pressed and destroyed around the staple clamp.

According to a further advantageous embodiment of the arrangement according to the invention, the ring is a flexible ring of steel, such as a rotationally rolled ring of spring steel. A suitably smooth, elastic plastic material can be inserted into the track instead of covering the track with a ring of spring steel.

BRIEF DESCRIPTION OF THE DRAWINGS

The invention will now be explained in more detail through the description of an embodiment of the roller arrangement according to the invention selected to serve as an example, with reference to FIGS. 2–6 of the attached drawings, where.

DETAILED DESCRIPTION

Figure 1:
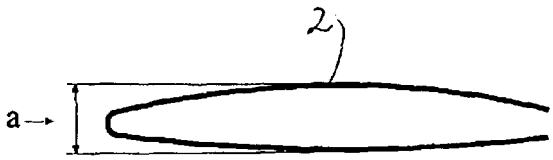
FIG. 1 illustrates the concept of projected booklet height for a folded booklet or book.

The roller arrangement according to the invention comprises two pairs of rollers with rotatable driven rollers. The rollers 1 of the first pair of rollers are furthermore controlled such that they can be displaced horizontally in FIG. 1, and they are subject to a spring force F1 that presses them towards each other. For the rollers 2 of the second pair of rollers, the right roller in the figure is mounted fixed, while the left roller can be displaced in a horizontal direction. The left roller 2 is subject to tension from a force F2 in the direction of the right roller 2 of the second pair of rollers. The rollers are mounted in bearings such that they can rotate between two opposite machine end-walls and they are driven to rotate, as is shown by the arrows 10 and 12, by motors that are not shown in the drawings.

The rollers are manufactured from a material, suitably steel, with a low friction against paper, which increases by a considerable degree the opportunities for folding booklets consisting of slippery sheets, as is described in more detail below.

Figure 2:
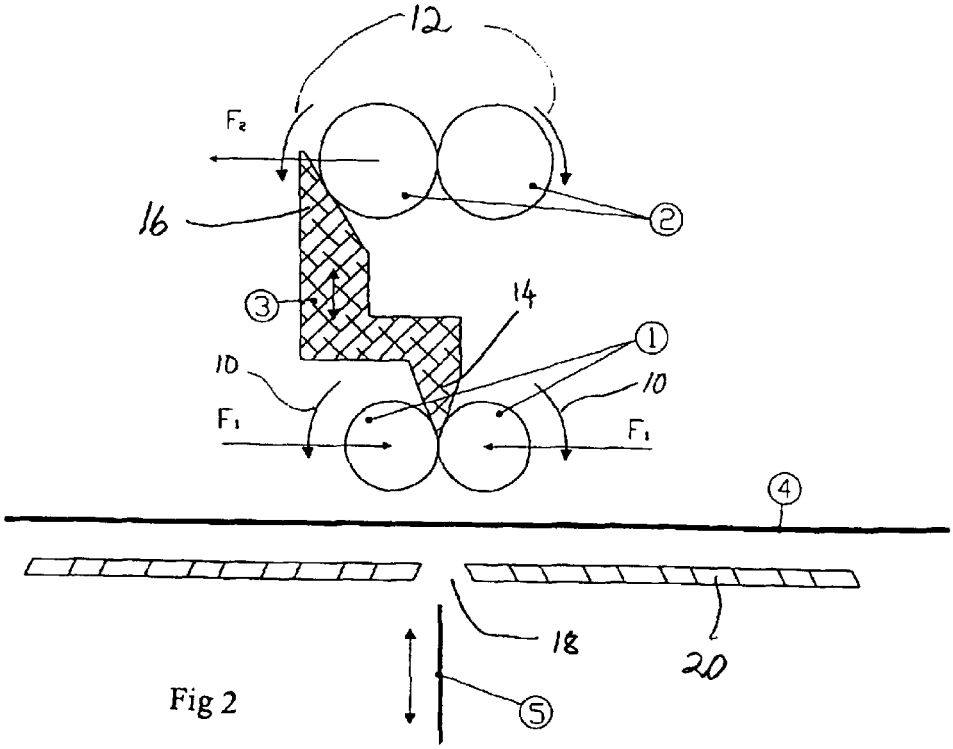
FIGS. 2 and 3 are side views of an embodiment of the roller arrangement according to the invention illustrating the principle of its construction and function.
Figure 3:
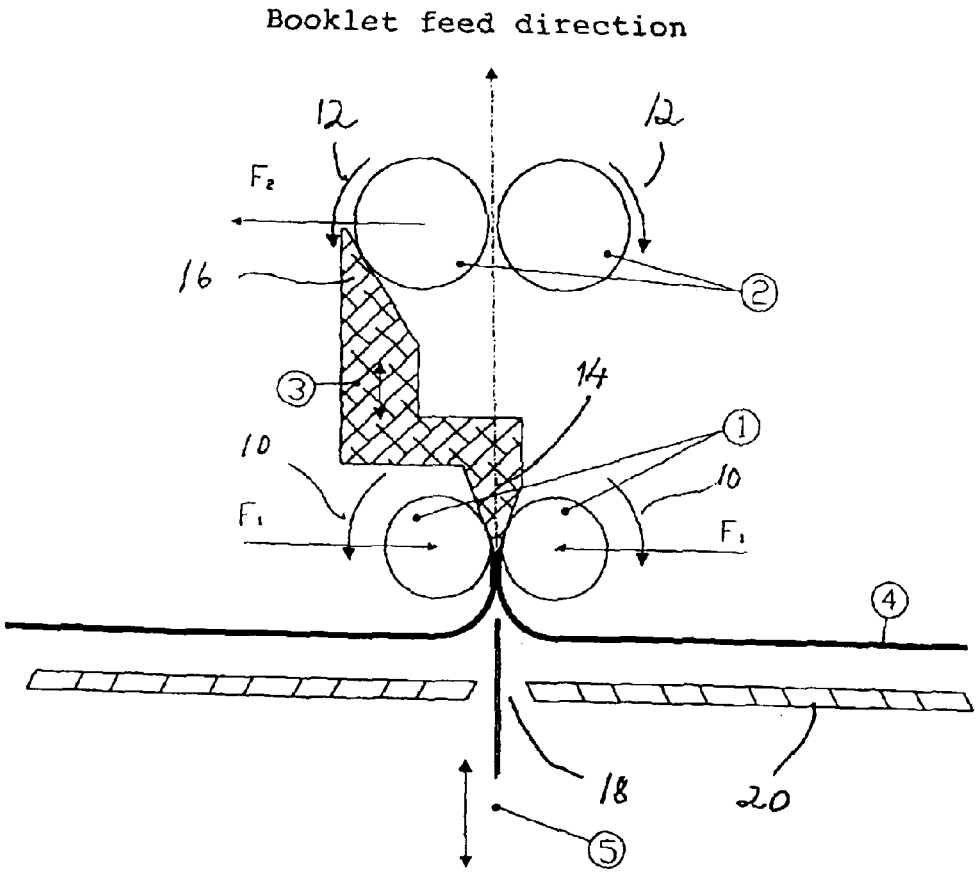

A wedge element 3, suitably designed as a sheet with wedge-shaped end sections 14, 16, is mounted for motion in the vertical direction in FIGS. 2 and 3. The wedge element 3 is pressed, with its end section 14 free for motion, against the rollers 1 by the spring force F2 from the mobile roller 2 of the second pair of rollers through the mobile roller 2 making contact with the oblique surface of the end section 16 of the wedge element 3.

The force F1 is typically approximately 100 times greater than the force F2.

The function of the roller arrangement according to the invention is as follows:

The stapled stack 4 is pressed in between the rotating rollers 1 of the first pair of rollers by a knife 5 that can move in the vertical direction and that is raised through a gap 18 in the base 20 on which the stack rests. In order to insert the stapled stack of sheets, the knife 5 pushes in between the rollers 1 of the first pair of rollers until it is just above the centre of the rollers 1.

When the rollers 1 of the first pair of rollers are separated, the wedge element 3 is pressed downwards in the drawing between the rollers 1 by the force F2 that influences the mobile roller 2 of the second pair of rollers. At the same time, the rollers 2 of the second pair of rollers will be set at a separation by a distance that is related to the magnitude of the separation of the rollers 1 of the first pair of rollers. The rollers 2 of the second pair of rollers at this stage are placed in a separated condition and rotate. The separation of the rollers 1 when the stapled stack of sheets is inserted between the rollers 1 thus results in a separation of the rollers 2 of the second pair of rollers that is suitable for the current stack of sheets. This adjustment of the rollers of the second pair of rollers take place completely mechanically and automatically, individually for each individual stack of sheets or booklet that is inserted between the rollers 1 of the first pair of rollers. When the booklet is subsequently inserted between the rollers 2, the large spring force F1 is used via the wedge element 3 to press the booklet between the rollers 2.

It can be advantageous in practice to design the roller arrangement such that the rollers 2 of the second pair of rollers are adjusted to a distance that is somewhat too small for the current booklet. When the booklet then reaches the second pair of rollers, the rollers 2 are then pressed somewhat further apart, which is fed back to the first pair of rollers in the form of a further separation of the rollers 1 of this pair of rollers. The pressure from the first pair of rollers on the booklet will in this way be somewhat lower; that is, the first pair of rollers releases to a certain degree its grip on the booklet, which facilitates error-free passage of the booklet through the roller arrangement.

Figures 4, 5, 6:
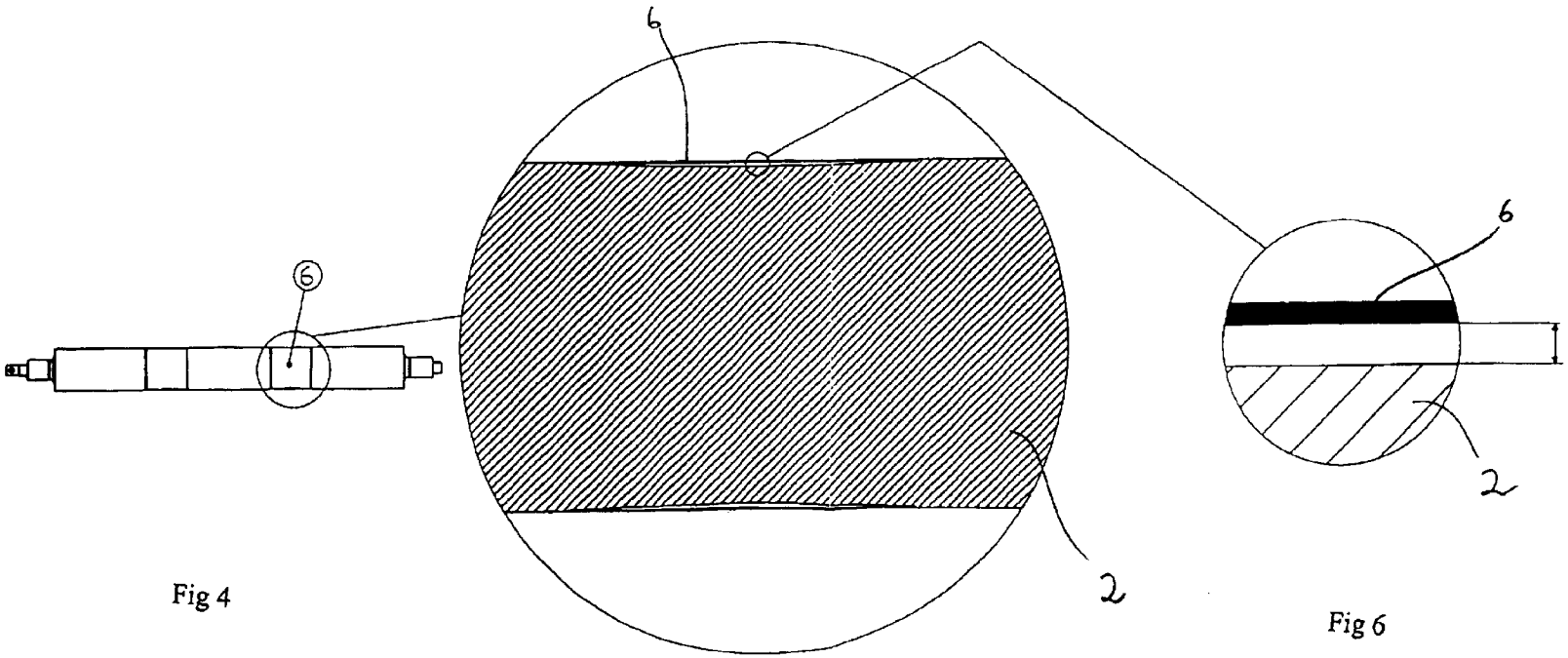
FIG. 4 shows a roller at the roller arrangement according to the invention with a track in the circumference of the roller covered by a rotationally rolled ring of spring steel.
FIG. 5 shows at a larger scale the track covered by spring steel.
FIG. 6 shows at an even higher scale a detail of the track covered by spring steel shown in FIG. 5.

When folding thin booklets, for which the thickness of the thread in the staple clamp is greater than the thickness of the booklet, the paper is readily destroyed during pressing around the clamp in the second pair of rollers. In order to solve this problem, at least one track is constructed around at least one of the rollers 2 of the second pair of rollers at the location at which the staple clamps are intended to pass during the folding. In order to avoid the paper being creased due to the locally lower pressure in the region of the track, the track is covered by a suitable elastic or flexible material such that the pressure on the paper is sufficient, even in the region of the track. Thus it is appropriate that the track is covered by a flexible ring 6 of, for example, steel or similar, see FIG. 4. The ring 6 can be constituted by, for example, a rotationally rolled ring of spring steel with an air gap b between the ring and the bottom of the track.

Alternatively, the track can be covered by or filled with a smooth, suitably elastic plastic material that offers essentially the same coefficient of friction as the material of the roller. On the other hand, the use of rubber is not appropriate for this purpose, since rubber absorbs ink that is then deposited onto other locations of the booklet or subsequent booklets. Furthermore, the coefficient of friction of rubber changes over time as a result of ageing of the rubber.

It is an advantage if the circumference of at least one of the rollers 1 of the first pair of rollers is designed having raised rings, such that the booklet or stack of sheets that is folded makes contact with these rings.

A roller arrangement comprising two pairs of rollers has been described above as an embodiment. The invention can, however, also be applied on arrangements of rollers comprising more that two pairs of rollers.

What is claimed is:

1. A roller arrangement for booklet makers, comprising at least a first and a second pair of rotatable driven rollers, between which booklets are intended to pass successively for folding, the said first pair of rollers comprising two rollers that are arranged such that they can move towards and away from each other and have a spring loading towards each other, and where the second pair of rollers comprises two rollers with a mutual separation that can be adjusted, and mechanical means arranged for, following the insertion of a booklet between the rollers of the first pair of rollers to automatically adjust the mutual separation of the rollers of the second pair of rollers in response to separation between the rollers of the first pair of rollers produced by insertion of the booklet therebetween, wherein said rollers are mounted in bearings such that they can rotate between two end pieces arranged at a distance from each other and said mechanical means comprises a wedge element arranged at each end piece, such that the wedge elements can move into the space between the rollers of the first pair of rollers when these are separated by a distance caused by insertion of the booklet therebetween whereupon the wedge elements adjust the distance between the rollers of the second pair of rollers depending on the said distance between the rollers of the first pair.

2. The arrangement according to claim 1, wherein the wedge elements include a wedge-shaped end section, intended to be inserted between the rollers of the first pair of rollers when these are separated by insertion of the booklet.

3. The arrangement according to claim 1, wherein the rollers of the second pair of rollers are placed under spring tension in a direction away from each other, whereby the said wedge elements are arranged to hold the rollers of the second pair of rollers, while overcoming the said spring tension, at a mutual separation that is determined by the said distance that the wedge element has been displaced as a response to the size of the separation of the rollers of the first pair of rollers.

4. The arrangement according to claim 3, wherein the wedge elements are arranged to be pressed by the spring force that influences the rollers of the second pair of rollers with their end section in between the rollers of the first pair of rollers, when these are separated.

5. The arrangement according to claim 3, wherein the rollers of the first pair of rollers are placed under an initial tension relative to each other with a force that is significantly greater than the spring force with which the rollers of the second pair of rollers are placed under tension relative to each other.

6. The arrangement according to claim 5, wherein force that influences the rollers of the first pair of rollers is of the order of magnitude of 100 times greater than the spring force that influences the rollers of the second pair of rollers.

7. The arrangement according to claim 1, wherein the contact surfaces of the rollers with paper are of a material that has low friction relative to paper.

8. The arrangement according to claim 7, wherein contact surfaces of the rollers are of steel.

9. The arrangement according to claim 1, wherein at least one of the rollers of the first pair of rollers is constructed with raised rings around its circumference, with which the booklet that is to be folded is intended to make contact.

10. The arrangement according to claim 9, wherein characterised in that said rings are rotationally rolled rings of spring steel.

11. The arrangement according to claim 1, wherein a knife is arranged to insert the booklet that is to be folded between the rollers of the first pair of rollers during the separation of the rollers.

12. The roller arrangement according to claim 1, wherein at least one of the rollers of the second pair of rollers is constructed with at least one track around its circumference at a location of which staple clamps are intended to pass during the folding, said track being covered by a ring of flexible material.

13. The arrangement according to claim 12, wherein the ring of flexible material is a smooth, elastic plastic material.

14. The arrangement according to claim 1, wherein said wedge elements each comprises a member having one end interposed between the rollers of the first pair and a second end bearing against one of the rollers of the second pair, said member being supported for movement relative to the rollers of the first and second pairs so that when the booklet enters between the rollers of the first pair, said member moves in response thereto and said one roller of the second pair moves in correspondence therewith to achieve automatic separation of the rollers of the second pair of rollers.

15. The arrangement according to claim 14, wherein said second end of said member is in bearing contact with said one roller of said second pair.

16. The arrangement according to claim 14, wherein said first and second pairs of rollers are arranged in succession and each said member extends between said rollers of the first and second pairs and is movable therebetween.

17. The arrangement according to claim 16, wherein said first end of each said member is wedge-shaped to fit between the rollers of the first pair and said second end of said member bears against said one roller of said second pair at a periphery thereof.

* * * * *